United States Patent [19]

Hirabayashi et al.

[11] Patent Number: 4,900,583

[45] Date of Patent: Feb. 13, 1990

[54] METHOD OF PRODUCING CAST COATED PAPER USING NEAR-INFRARED RADIATION

[75] Inventors: Tetsuya Hirabayashi; Mikio Takahashi, both of Amagasaki, Japan

[73] Assignee: Kanzaki Paper Mfg. Co., Ltd., Tokyo, Japan

[21] Appl. No.: 183,659

[22] Filed: Apr. 19, 1988

[30] Foreign Application Priority Data

Apr. 30, 1987 [JP] Japan ..... 62-108086

[51] Int. Cl.[4] ..... B05D 3/06; B05D 3/12

[52] U.S. Cl. ..... 427/55; 427/362

[58] Field of Search ..... 427/55, 362, 316, 326, 427/366, 382; 264/175, 212

[56] References Cited

U.S. PATENT DOCUMENTS

| | | | |
|---|---|---|---|
| 2,321,939 | 6/1943 | Quinn | 427/55 |
| 3,268,354 | 8/1966 | Hain | 427/362 |
| 3,364,061 | 1/1968 | Mitchell et al. | 427/55 |
| 3,399,074 | 8/1968 | Gottwald et al. | 426/362 |
| 3,409,460 | 11/1968 | Mitchell et al. | 427/55 |
| 3,554,502 | 1/1971 | Rye et al. | 427/55 |
| 3,575,707 | 4/1971 | Ploetz et al. | 427/362 |
| 3,973,328 | 8/1976 | Theobold | 427/55 |
| 4,048,380 | 9/1977 | Blakey et al. | 427/362 |
| 4,265,969 | 5/1981 | Yasuda et al. | 427/55 |
| 4,464,220 | 8/1984 | Beer | 427/55 |
| 4,486,033 | 12/1984 | Parrotta | 427/55 |
| 4,513,516 | 4/1985 | Björnberg | 34/4 |
| 4,515,833 | 5/1985 | Nojima et al. | 427/362 |
| 4,520,048 | 5/1985 | Ranger | 427/362 |
| 4,535,548 | 8/1985 | Hyde | 427/55 |
| 4,594,266 | 6/1986 | Lemaire et al. | 427/55 |
| 4,620,992 | 11/1986 | Nojima et al. | 427/362 |

FOREIGN PATENT DOCUMENTS

| | | | |
|---|---|---|---|
| 854501 | 11/1960 | United Kingdom | 427/362 |
| 962123 | 6/1964 | United Kingdom | 427/362 |

*Primary Examiner*—Norman Morgenstern
*Assistant Examiner*—Marianne L. Padgett

[57] ABSTRACT

In a method of producing cast coated paper in which a wet coating layer containing as its main components, pigment and adhesive, is heated to permit a gel state to be formed in the layer, or is dried and then rewetted, and then is pressed against a highly polished finishing surface of a heated drum so as to be provided with a glazed finish.

The present invention provides an improvement wherein an apparatus for emitting near-infrared radiations into the wet coating layer is employed as a means for permitting a gel state to be formed in the layer or as a means for drying the wet coating layer. The apparatus emits near-infrared radiations having wave lengths of 0.75 to 2.0 μm at the peak wave length of their range which are directed into the wet coating layer.

3 Claims, 2 Drawing Sheets

METHOD OF PRODUCING CAST COATED PAPER USING NEAR-INFRARED RADIATION

BACKGROUND OF THE INVENTION

1. Field of the Invention

The present invention relates to a method of producing cast coated paper, and more particularly, to the method in which the near-infrared radiation serves as heating means in the step of heating a layer of wet coating applied on a web of paper to permit a gel structure to be formed therein, or to permit the wet layer of coating to be dried.

2. Description of the Prior Art

As is well known, there are several conventional methods of producing cast coated high-gloss paper for printing. These methods include (1) a wet casting method adapted to produce a glazed coated layer on a web of paper by applying a layer of coating comprising a mineral pigment and an adhesive to a web of paper and pressing the wet coating layer against the heated highly polished surface of a casting drum or roll, (2) a rewet casting method in which the applied layer of wet coating is first dried, then plasticized with a rewetting liquid and pressed against the heated polished surface of a casting drum, and (3) a gel-casting method adapted to produce a glazed coated layer by pressing the coating layer in a gel state against a heated polished surface of a casting drum.

In any of these conventional casting methods, the coating layer in a water plasticized state is pressed against the highly polished finishing surface of the heated drum by means of a press roll so as to be dried in contact therewith and released from the heated drum thereby producing a glazed finish on the surface of the coated layer.

Of these conventional methods, in the rewet casting method, and the gel casting method, the coating layer is in a dried state or having a gel state before the layer is pressed against the finishing surface of the heated drum. Therefore, the coating layer can be pressed against the drum having a surface temperature of at least 90° C., and the cast coating operation can be performed at a speed much higher than that of the wet casting method, without any fear of rupturing the coating layer or of breaking the paper, both of which result from a rapid evaporation of a large amount of moisture in the coating layer in the wet casting method.

However, in the rewet casting method, since the coating layer, having been dried,must be rewetted, plasticization of the coating layer is liable to be insufficient. On the other hand, in the gel-casting method, when a sufficiently firm gel state is not formed in the coating layer, the coating layer tends to be pressed against the drum in a poor manner causing an uneven and loose contact with the drum. However, in these cases, it is possible to produce a cast coated paper having a relatively uniform glazed finish when the cast coating operation is conducted at a relatively low speed. It is difficult to produce the cast coated paper having such relatively uniform glazed finish when the cast coating operation is conducted at a relatively high speed, because many defects such as pinhole-like dots, gloss irregularity and the like are involved in such high-speed operation. Furthermore, in each of the rewet casting method and the gel-casting method, a so-called "mottling" problem, which is a gloss irregularity appearing in the surface of the cast coated paper, is most likely to occur.

Hitherto, in order to resolve the above problems, pigments excellent in air-permeability have been employed, while the base paper has been improved in its drying characteristics. However, a satisfactory result is still not obtained.

Hitherto, in both of the rewet casting method and the gel-casting method, there have been employed suitable heating/drying means for the wet coating layer, such as steam heaters, microwave, laser, electron-beam and the like. Among these heaters, the gas heaters and the electrical heaters, which are generally well-known as a drying device, emit middle-or-far-infrared radiations having wave lengths longer than 2.5 μm at the peak wave length of their ranges or other infrared radiations but do not emit near-infrared radiations. In case that the infrared radiations except the near-infrared ratiations are utilized for drying the wet coating layer, prior to casting or utilized for evaporating the moisture of the layer to permit a gel structure to be formed in the layer, only a surface portion of the layer is rapidly dried so that the infrared radiations, other than the near-infrared radiations, are not adequate to dry the wet coated layer in the casting methods. Consequently, as will be clarified later, it is impossible for middle-or far-infrared radiations to realize predetermined effects of the present invention.

SUMMARY OF THE INVENTION

Infrared radiations, in general, are divided into three ranges which are, near-infrared ones having wave lengths from 0.75 μm to 2.5 μm, intermediate-infrared ones having wave lengths from 2.5 μm to 25 μm and far-infrared ones having wave lengths longer than 25 μm.

It is the object of the present invention to provide a method for producing the cast coated paper with a glazed finish at a relatively high casting speed in a stable manner, by utilizing the near infrared radiations having wave lengths shorter than 2.0 μm at the peak wave length of their ranges for heating and drying the wet coating payer in the rewet casting method and in the gel-casting method, whereby many defects such as the above-mentioned pinhole-like dots, gloss irregularity, uneven contact between the wet coated layer and the heated drum and like defects as may occur in these previous casting methods are prevented from occurring.

Namely, in the conventional drying steps, for example, such as the steam heating/drying step, gas heating step, hot-air heating step, and the like drying steps, the surface portion of the coating layer is rapidly dried to make it impossible to dry uniformly the entire layer, particularly to dry uniformly the layer in a direction of its depth parallel to Z-axis. This leads to many defects of the layer such as uneven drying of the layer, binder migration and like defects causing a poor contact of the layer with the heated drum, pin-hole like dots and gloss irregularity. Consequently, hitherto, the casting operation can only be carried out at a relatively low speed with these drying steps.

In view of such circumstances, the inventors of the present invention have studied the above defects inherent in the conventional methods, and found that drying conditions of the wet coating layer, particularly, in the formation step of a gel structure therein and in the rewet casting method, exert powerful influences on the occurences of these defects.

Based on this finding, the inventors of the present invention have gone on with further studies, and found that the near-infrared radiations can suitably serve as means for heating the wet coating layer to permit a gel structure to be formed in the layer or can serve as means for drying the wet coating layer, prior to re-wetting, and furthermore, found that such near-infrared radiations can dry the entire wet coated layer uniformly to make the layer bulky. Owing to the above findings the present invention was made.

According to the present invention, there is provided; in a method of producing cast coated paper in which a wet coating layer containing, as its main components pigment and adhesive, is heated to permit a gel structure to be formed in said layer, or is dried prior to being rewetted and then is pressed against the highly polished finishing surface of a heated drum so as to be provided with glazed finish of said coating layer, the improvement wherein an apparatus for emitting near-infrared radiations into said wet coating layer is employed as a means for permitting a gel state to be formed in said layer or as a means for drying said wet coating layer prior to rewetting, said near-infrared radiations having wave lengths ranging from 0.75 to 2.0 μm at the peak wave length of their ranges.

DESCRIPTION OF THE PREFERRED EMBODIMENTS

Figure 1:
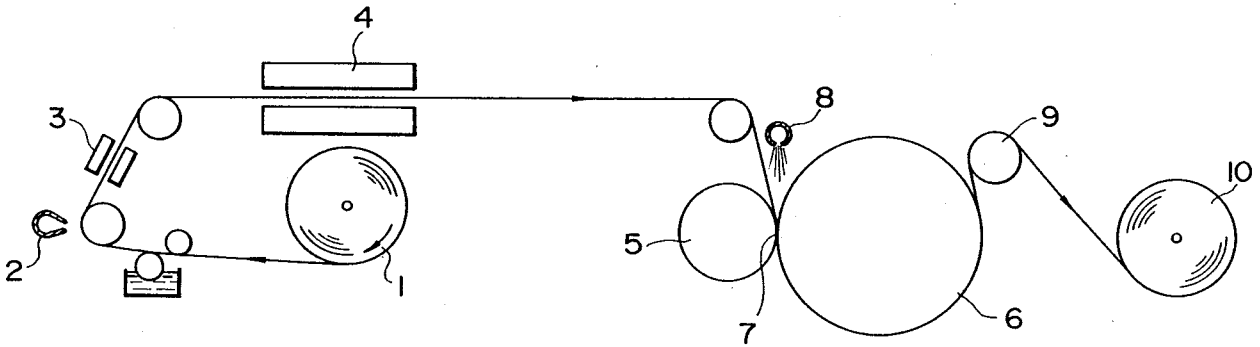
FIG. 1 is a schematic view of a cast coater employed in the embodiment of the present invention.

In the method of the present invention, a wet layer of coating made of an aqueous mixture of pigment, adhesive and like is used as in the conventional casting methods. The pigment and the adhesive constitute main components of the mixture. The pigment to be used for the mixture comprises one or more of the conventional pigments for the cast coated paper, for example, clay, kaolin, aluminum hydroxide, calcium carbonate, titanium dioxide, barium sulfate, zinc oxide, satin white, plastic pigment, and the like.

The adhesive of the mixture comprises one or more of the conventional adhesives for cast coated paper selected from the group consisting of, for example, proteins such as casein, soybean protein, synthetic proteins and the like; latices such as conjugated diene polymer latices, for example, styrene-butadiene copolymer, methyl methacrylate and butadiene copolymers; latices such as polymers or copolymers of acrylic acid and/or methacrylic acid, and esters of these acids; latices of vinyl polymers such as ethylene-vinyl acetate copolymer, or alkali-soluble or -insoluble polymeric latices prepared by modifying the latices of vinyl polymers with the use of monomers containing functional groups such as carboxyl group and the like; synthetic resin adhesives such as polyvinyl alcohol, olefin-maleic anhydride resins, melamine resins and the like; starches such as cationic starches, oxidized starches, and the like; and cellulose derivatives such as carboxymethylcellulose, hydroxyethyl cellulose and the like.

The quantity of the adhesive to be used is 5 to 50 parts, preferably 10 to 30 parts, by weight for 100 parts of weight of the pigment.

If necessary, auxiliary agents such as anti-foaming agents, dye stuff, release agents, and fluidity modifiers are added to the mixture. For example, in the gel-casting method, in order to facilitate the formation of a gel state in the wet coated layer, some auxiliary agents made of salts of multivalent metals such as, zinc, aluminum, magnesium, calcium, barium, and like metals are added to the mixture or wet coated layer to provide the following composition: pigment, 100 parts by weight; and the auxiliary agents, 0.5 to 10 parts by weight.

In application of the mixture or wet coating layer to the surface of the base paper, there is employed a suitable coater, for example such as blade coater, air-knife coater, roll coater, reverse-roll coaters, bar coater, flood coaters, extrusion coater, gravure coater, Chamflex coaters, size-press coater and the like. The mixture can be applied to the surface of the base paper through either machine coating or off-machine coating. In this case the solids content of the coating mixture ranges from about 40 to 70% by weight, preferably, from 45 to 65% by weight as required for the operating efficiency of such application.

As for the base paper to be employed in the method of the present invention, it is possible to employ paper base or paperboard base, with the basis weight of substantially 30 to 400 g/m$^2$ used for coated paper or cast coated paper for printing. Such paper can have an acid or alkaline pH, and medium-grade (or ground wood) base paper which contains high yield pulp such as mechanical pulp may also be used. Also useable as the base paper is coated paper applied with pigment coating on the back surface of cast coated layer or preliminarily coated paper.

The coating mixture having the foregoing composition, is applied to the surface of the base paper in an amount equal to 10 to 50 g/m$^2$ dry weight, and preferably in an amount equal to 15 to 35 g/m$^2$ dry weight in view of a better quality of the cast coated paper and a higher cast coating speed.

As for the rewetting liquid employed in the rewet casting method, according to the present invention, it is possible to employ a water solution or emulsion containing approximately a 0.01 to 3% by weight of a release agent such as an aqueous polyethylene emulsion, fatty acid soap, calcium stearate, microcrystalline wax, surface-active agent, sulfonated oil and the like.

As described in the above, the gist of the present invention resides in that the near-infrared radiations are employed to serve as means for drying the wet coating layer in the gel-casting method to permit a gel state to be formed in the layer, and, for drying the wet coating layer in the rewet casting method prior to rewetting.

The infrared radiations are generally classified into the following three categories; near-infrared radiations having wave lengths of from 0.75 to 2.5 μm; intermediate-infrared radiations having wave lengths of 2.5 to 25 μm, and far-infrared radiations having wave lengths of from 25 to 2000 μm. In the conventional infrared-radiation dryers, as described above, there have been employed the intermediate infrared radiations having wave lengths of at least 2.5 μm and the far infrared radiations having wave lengths of longer than 25 μm. On the other hand, there has not been employed a drying device with the near-infrared radiations, so far, for drying the wet coated layer in the gel casting method to permit a gel state to be formed in the layer, and for drying the wet coated layer prior to rewetting in the rewet casting method.

In the method of the present invention, there is employed the near infrared radiations especially having wave lengths of 0.75 to 2.0 μm, at the peak wave length of their ranges, preferably of 1.2 to 1.8 μm. In case that the near-infrared radiations having wave lengths of shorter than 0.75 μm at the peak of their ranges are employed, it is impossible to sufficiently dry the wet coating layer to permit a sufficient gel state to be formed in the layer. Consequently, in this case, it is impossible to accomplish the expected effect of the present invention. On the other hand, in case that the near-infrared radiations having wave lengths of longer than 2.1 μm at the peak of their ranges are employed, the wet coating layer suffers from binder migration in the rewet casting method, while the wet coating will suffer from poor formation of its gel state in the gel-casting method. Consequently, in this latter case, it is also impossible to accomplish the expected effect of the present invention.

Although it is still not apparent why the near-infrared radiations specified in the method of the present invention are effective as described in the above, the reason why it seems to be that such near-infrared radiations are excellent in the power of transmissions rate for the wet coating layer while large in energy density, to make it possible that the wet coating layer is rapidly and uniformly dried to permit an uniform gel state to be formed therein in the gel-casting method, and to make it possible for the wet coating layer to be uniformly dried in the rewet casting method, whereby, in a high-speed cast coating, the wet coating layer is dried to have a bulky form. Since the wet coating layer is dried under such conditions, the thus dried layer can be well spread to cover over the surface of the base paper. Consequently, the surface of the coating can be brought into uniform and close contact with the surface of the heated drum at a position between the drum and the corresponding press roll, i.e. at a nip therebetween, to make it possible to produce a cast-coated paper with excellent glazed finish free from pinhole-like dots, gloss irregularity and any other defects. According to the present invention, it is preferable for the near infrared radiations to be so emitted into the wet coated layer that the surface of the coating layer is heated to a temperature of more than 30° C. plus its initial temperature.

The heated drum employed in the present invention will now be described in detail.

In general, the drum has a diameter of 1000 to 5000 mm preferably, of 1200 to 3600 mm in view of runnability. The surface temperature of the drum is at least 90° C., or higher, preferably 100° C. to 160° C. for best quality and runnability. The press roll for pressing the wet coating layer against the heated drum has a diameter of 200 to 1500 mm, preferably of from 300 to 900 mm and is covered with rubber. The pressure of the press roll for pressing the coated paper against the drum is approximately 30 to 350 kg/cm, preferably 80 to 250 kg/cm.

Various conventional devices known in the field of producing coated paper, such as a water applicator roll, an electrostatic humidifier or a steam humidifier may also be used in the present invention for the purpose of moistening the finished cast coated paper or adjusting the moisture thereof in a range which does not obstruct the effects or advantages of the present invention.

EXAMPLES:

The present invention will be described now with reference to examples and comparison examples. The invention is not limited to these examples. The parts and percentage in the examples and comparison examples designate parts and percentage by weight, unless otherwise specified.

EXAMPLES 1 to 2, AND COMPARISON EXAMPLES 1 to 4:

70 parts of kaolin, 30 parts of precipitated calcium carbonate (solid content) and 0.5 parts of sodium polyacrylate were dispersed in water by means of Cowles dissolver so as to prepare a pigment slurry having 60% solids content. 0.5 part of triutyl phosphate as an anti-foaming agent, 1 part of ammonium stearate as a release agent, 10 parts (solids content) of casein which is dissolved in water and 18 parts of acrylic acid-butadiene-methylmethacrylate copolymer (2%-33%-65%) latex as adhesive. 3 parts of zinc sulfate ($ZnSO_4$) dissolved in water and water were mixed with the above pigment slurry so as to obtain a coating composition of a solids concentration of 45%. The rewet casting was carried out with the coating composition by means of a device shown in FIG. 1. More particularly, as shown in FIG. 1, the thus obtained mixture was applied to the surface of a base paper 1 having a basis weight of 80 g/m$^2$ by means of an air-knife coater 2 to form a wet coating layer on the base paper, and dried to have a moisture content of 6% by means of a near-infrared radiation unit 3 and an air-floating drier 4 so as to produce a cast coated paper having a coating weight of 28 g/m$^2$ dry basis.

Then, the paper was passed through a nip 7 between a press roll 5 having a diameter of 750 mm and a heated chrome-plated casting drum 6 having a diameter of 1500 mm, while rewetting the coating layer with 0.5% concentration polyethylene-emulsion rewetting liquid supplied through a nozzle 8 positioned above the nip 7. The thus rewetted coating layer on the base paper, as it is pressed against the drum at nip 7, is heated to a temperature corresponding to that of the surface temperature of the casting drum 6, heated to a temperature of 105° C. at its surface, and also is subjected to a nip pressure of 200 Kg/m$^2$ exerted by the press roll 5, so as to be rapidly dried. After having been dried, the paper was released from the casting drum 6 at a cast coating speed of 65 m/minute at take-off roll 9 and was wound into a roll 10.

The following Table 1 shows data as to (a.) the wave lengths of the infrared radiations employed in the above Examples 1, 2 and Comparison Examples 1 to 4, (b.) the difference in the temperature of the surface of the coated paper paper before and after being subjected to the near-infrared radiations in the above Examples, and (c.) the qualities of the thus obtained cast coated paper in the above Examples.

In each of the Examples 1 and 2, the near-infrared radiations were obtained from a light source constructed of a filament, a condensing plate of the light and a reflector. Thus the near-infrared radiation was obtained by the tungsten filament electrically heated to a temperature of 1600° to 2400° K., the near-infrared radiation obtained was condensed by the stainless steel condensing plate (positioned over the filament) which was gold-plated,and was directed to the surface of the coating layer. The radiations penetrated through the paper will be reflected by an aluminum plate positioned in the back of the paper and they are again emitted to the back of the same paper. In this way, an effective and uniform heating and drying is accomplished.

In each of the Comparison Examples 1 to 2, a heat source consisting of a special glass tube coated on its interior with a zirconium oxide compound was provided in place of, and in a position corresponding to that of, the near-infrared radiation unit 3 in FIG. 1. The interior of the special glass tube was heated by a city-gas burner to serve as the heat source for emitting the intermediate-infrared radiations.

In the Comparison Example 3, a halogen lamp with a reflection film for reflecting or shutting-in the infrared radiations was employed in place of the near-infrared radiation unit 3 at the same position as that of the unit 3.

In the Comparison Example 4, the near-infrared radiation unit 3 as shown in FIG. 1 was eliminated, and the air-floating drier 4 having a temperature of 170° C. was employed as the only heater.

Figure 2:
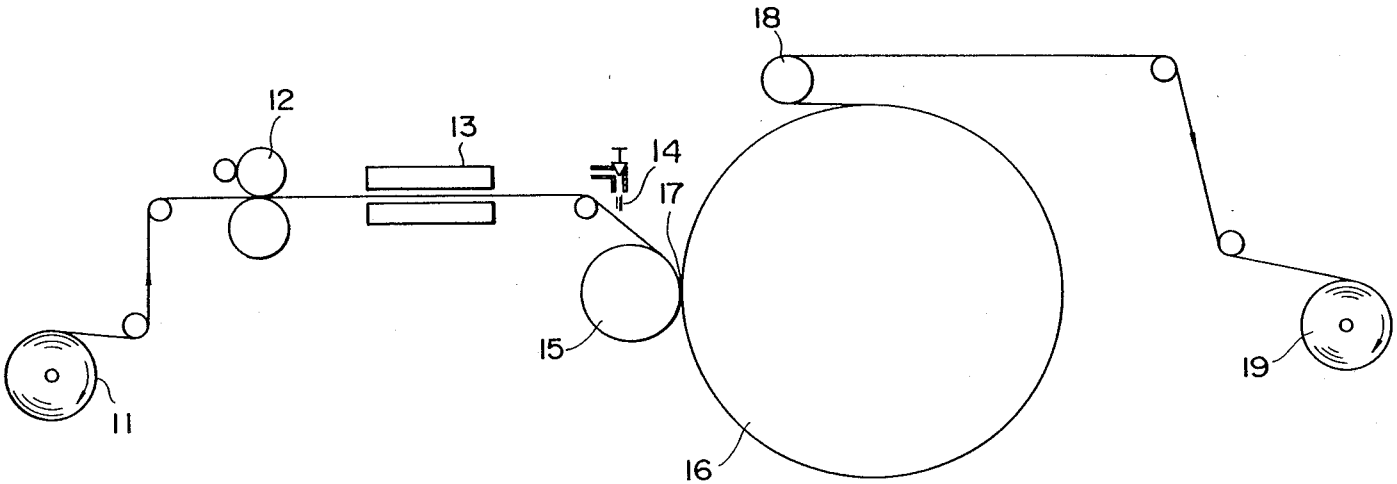
FIG. 2 is a schematic view of another cast coater employed in the embodiment of the present invention.

EXAMPLES 3 AND REFERENCE SAMPLE 5:

100 parts of kaolin were dispersed in water with the use of 0.5 part of sodium hexametaphosphate serving as a dispersing agent to prepare a pigment slurry having a solids content of 67%. To the thus prepared slurry were added 0.6 part of tributyl phosphate, 0.05 part of caustic soda, 1.0 part of ammonium oleate, 15 parts of casein dissolved in water with the use of ammonia, serving as an adhesive, 15 parts (solids content) of styrene-butadiene copolymer latex as another adhesive, and 2.0 parts of barium chloride as an auxiliary agent. As a result of the above additions, a coating mixture having a solids content of 48% was obtained. Such mixture was applied to a base paper 11 having a basis weight of 90 g/m$^2$ by means of a roll coater 12 in an apparatus shown in FIG. 2 according to the gel casting method so as to form a coating layer having a weight of 25 g/m$^2$ dry basis. The thus prepared coating layer was then heated by a near-infrared radiation unit 13 to permit a gel state to be formed in the coating layer. After that, the coating layer was subjected to a hot steam 14 while passed through a nip 17 with a water pool retained in said nip between press roll 15 (having a diameter of 800 mm) and heated cast coating drum 16 (having a diameter of 3000 mm and a surface temperature of 108° C.) so that the coating layer having the gel state therein was subjected to a nip pressure of 100 kg/cm$^2$ in the nip 17 thereby being brought into complete contact with the surface of the heated drum 16, whereby drying of the coating layer is completed. The thus dried cast coated paper released from the heated drum 16 at take off roll 18 at a casting speed of 55 m/minute to obtain a product of completed cast coated paper 19.

The following Table 2 shows data as to the wave lengths of the infrared radiations employed in Example 3 and in Comparison Example 5, and qualities of the completed cast coated papers. In Example 3, the same light source as that employed in the Examples 1 and 2, was employed. On the other hand, in the Comparison Example 5, the same light source as that employed in the Comparison Example 1 was employed. The qualities of the completed cast coated papers were evaluated in the same manner as that employed in the Example 1.

EFFECTS OF THE INVENTION:

As is clear from Tables 1 and 2, in the method of the present invention it is possible to prevent the irregularity in contact between the coating layer and the heated drum, and to considerably improve the coating layer in its gloss so as to ensure a high quality of the cast coated paper. In addition, the present invention also makes it possible to conduct a cast coating operation for a long period of time in a very stable manner.

TABLE 1

| | Rewet casting method | | | |
|---|---|---|---|---|
| | Peak wave length of the infrared radiations (μm) | Difference of temperature on the paper surface between before and after the emission of Infrared Radiations (°C.) | Irregularity of Contact | Gloss |
| Example 1 | 1.2 | 35 | O | 91 |
| Example 2 | 1.8 | 42 | O | 90 |
| Comparison Example 1 | 5.7 | 45 | x | 82 |
| Comparison Example 2 | 2.5 | 42 | x | 80 |
| Comparison Example 3 | 0.7 | 18 | xx | 76 |
| Comparison Example 4 | no radiation | 0 | xx | 75 |

Remarks:
(1) Evaluation of the irregularity of contact between the wet coated layer and the surface of the heated drum are defined as follows:
O substantially no irregularity is recognized;
x some irregularities are recognized; and
xx considerable irregularities are recognized.
(2) Evaluation of the gloss: The evaluation of the gloss is conducted according to Japanese Industrial, wherein: a larger number shows a higher gloss.

TABLE 2

| | Gel-casting method | | | |
|---|---|---|---|---|
| | Peak wave length of the infrared radiations (μm) | Difference of temperature on the paper surface between before and after the emission of Infrared Radiations (°C.) | Irregularity of Contact | Gloss |
| Example 3 | 1.2 μm | 38 | O | 90 |
| Comparison Example 5 | 5.7 | 47 | x | 75 |

What is claimed is:

1. In a method of producing cast coated paper in which a wet coating layer containing as its main components pigment and adhesive applied to a web of paper is heated to permit a gel state to be formed in said layer or is dried after which it is rewetted, and said heated coating layer is then pressed against the surface of a heated drum having a highly polished finishing surface and is dried in contact with said drum surface to there by produce a glazed finish on the surface of said coating layer, the improvement which comprises heating said wet coating layer by means of near-infrared radiations generated by electrically heating a light source filament to a temperature of from about 1600° K. to about 3,800° K. so as to emit near-infrared radiations having wave lengths of 1.8 μm to 0.75 μm at the peak wave lengths of their ranges.

2. The method of producing cast coated paper according to claim 1, wherein said wet coating layer is heated by means of an infrared radiation unit consisting of a tungsten filament, a condenser and an opposed reflector.

3. The method of producing cast coated paper according to claim 1, wherein the difference in the temperature of said paper coating layer, before and after heating by means of said near-infrared radiations, is 30° C. or more.

* * * * *